US006415454B1

(12) United States Patent
Pierson

(10) Patent No.: US 6,415,454 B1
(45) Date of Patent: Jul. 9, 2002

(54) TOILET SEAT LIFTING DEVICE

(76) Inventor: Michael Pierson, 611 Lansdowne Street, Kamloops, British Columbia (CA), V2C 1Y6

( * ) Notice: Subject to any disclaimer, the term of this patent is extended or adjusted under 35 U.S.C. 154(b) by 0 days.

(21) Appl. No.: 09/805,042

(22) Filed: Mar. 14, 2001

(51) Int. Cl.[7] ..... A47K 13/10
(52) U.S. Cl. ..... 4/246.1
(58) Field of Search ..... 4/246.1

(56) References Cited

U.S. PATENT DOCUMENTS 3,191,193 A * 6/1965 Bogenberger ..... 4/246.1
5,027,472 A * 7/1991 Goodman ..... 4/246.1 X

* cited by examiner

*Primary Examiner*—Charles E. Phillips
(74) *Attorney, Agent, or Firm*—Dennison, Schultz & Dougherty

(57) ABSTRACT

A device for lifting and lowering a toilet seat and cover in a sanitary manner is disclosed herein. The device easily affixes to the underside of a toilet seat and is equipped with a handle so as to eliminate the need for any direct hand contact by the user with the seat, cover or bowl of a toilet.

3 Claims, 5 Drawing Sheets

TOILET SEAT LIFTING DEVICE

FIELD OF THE INVENTION

This invention relates to a lifting device, and more particularly, to a sanitary lifting device which allows the seat and cover of a toilet to be raised and lowered without any direct hand contact.

BACKGROUND OF THE INVENTION

Toilet seats are commonly raised and lowered by manually grasping the edge or underside of the seat, This practice can be undesirable and somewhat unsanitary, particularly in public washrooms where the toilet facilities are made available to a large number of people with unknown health and sanitary habits. Guests using a washroom at a private residence may also experience some level of discomfort when forced to grasp the lid or seat of a toilet with their hands.

As such, there is a need for a more sanitary method of raising and lowering the seat of a toilet. The devices illustrated in the prior art typically include a handle attachment for a toilet seat which can be either hand or foot operated. The means provided for attaching the handle to the seat range from an adhesive to various types of clamps operable with bolts or screws. While these methods are capable of achieving their purpose to some extent, they are not without disadvantages.

When an adhesive is employed as an attachment means it will often fail or break and require replacing. This is mainly a result of the stress and strain imposed from the repeated raising and lowering of the seat. Most lifting devices which utilize a clamping means for affixing the handle to a toilet seat are also disadvantageous in that they are generally composed of numerous parts. This requires more time and effort to assemble and disassemble for cleaning and adds cost. Furthermore, when bolts or screws are employed, the device is also likely to be more susceptible to rust. Therefore, although devices for lifting the seat and cover of a toilet are presently known in the prior art, there still remains a need for further improvement.

SUMMARY OF THE INVENTION

It is therefore a general objective of the present invention to provide a sanitary device that allows a user to raise and lower the seat and cover of a toilet without having to directly touch them. It is another objective of this invention to provide a handle attachment which is easily affixed to the seat and easily removed for cleaning. A further objective of this invention is to provide a handle attachment device strong enough to lift both the seat and the cover at the same time, without placing any undue stress or strain on the device or the toilet seat that may result in damage.

The first objective is achieved by providing a handle that can be affixed to the underside of a toilet seat and grasped by hand to assist in manually raising and lowering the seat and cover of a toilet.

The second objective of providing a lifting device which is easily assembled and disassembled for cleaning purposes is preferably achieved by providing a device in which all components are moulded as a single unit. This one piece moulding includes a handle, an attaching rod, a forward and rearward lever, and form-fitting flexible clips that clamp around the edges of a toilet seat to secure the device in place. When all components are moulded into one unit in this way, no assembly is necessary and the device can be easily removed and affixed to the toilet seat as needed. Furthermore, the use of flexible clips to affix the device eliminates the need for metal bolts or screws, which can put the device at risk of falling prey to rust.

The final objective of providing a stronger device that is capable of lifting both the seat and the cover at the same time, is achieved by the addition of the forward and rearward levers. Theses levers reduce the stress and strain placed on the handle attachment and act to prevent the clips from twisting free when the handle is in use.

According to the present invention then, there is provided a lifting aid for a pivotable, rimmed seat, comprising attachment means for releasably connecting said aid to laterally opposite edges of the said seat's rim; a flange portion extending between said attachment means, said flange portion being disposed beneath a lower surface of said seat when said aid is attached thereto; and a handle disposed outwardly relative to said attachment means so that said handle is conveniently positioned for lifting and lowering said seat when said aid is connected thereto.

BRIEF DESCRIPTION OF THE DRAWINGS

The preferred embodiments of the present invention will now be described in greater detail, and will be better understood when read in conjunction with the following drawings, in which.

DETAILED DESCRIPTION OF THE DRAWINGS

Figure 6:
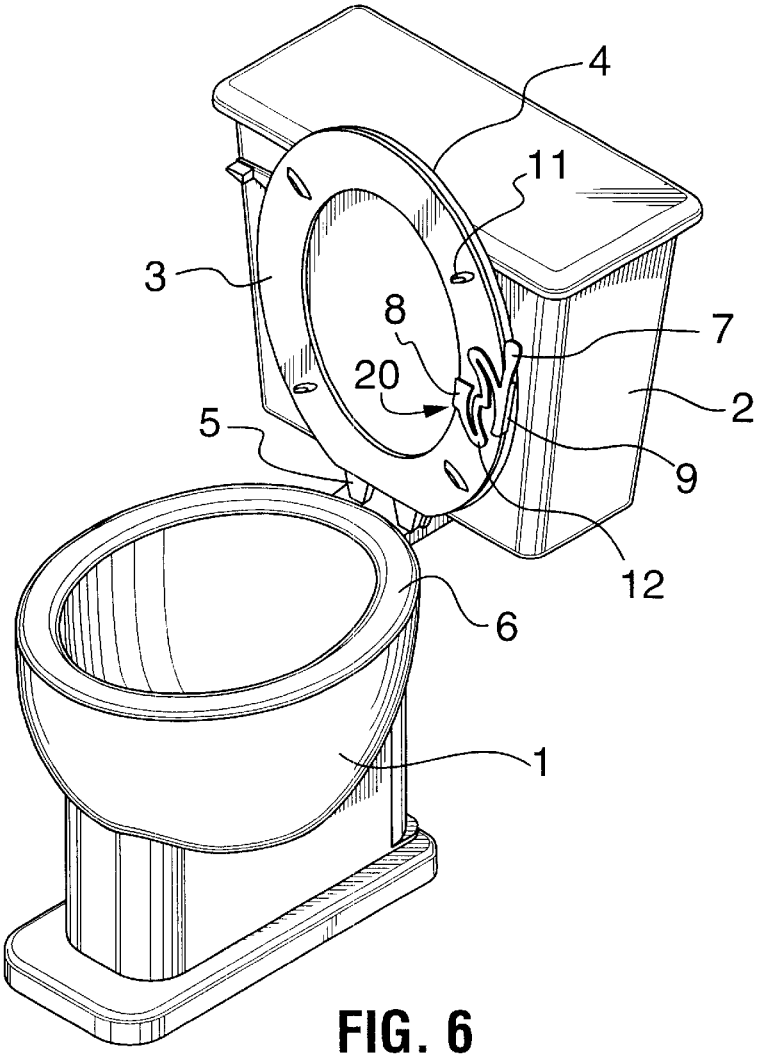
FIG. 6 is a perspective view of the lifting device connected to the seat of a toilet with both the seat and cover in a raised position.
Figure 7:
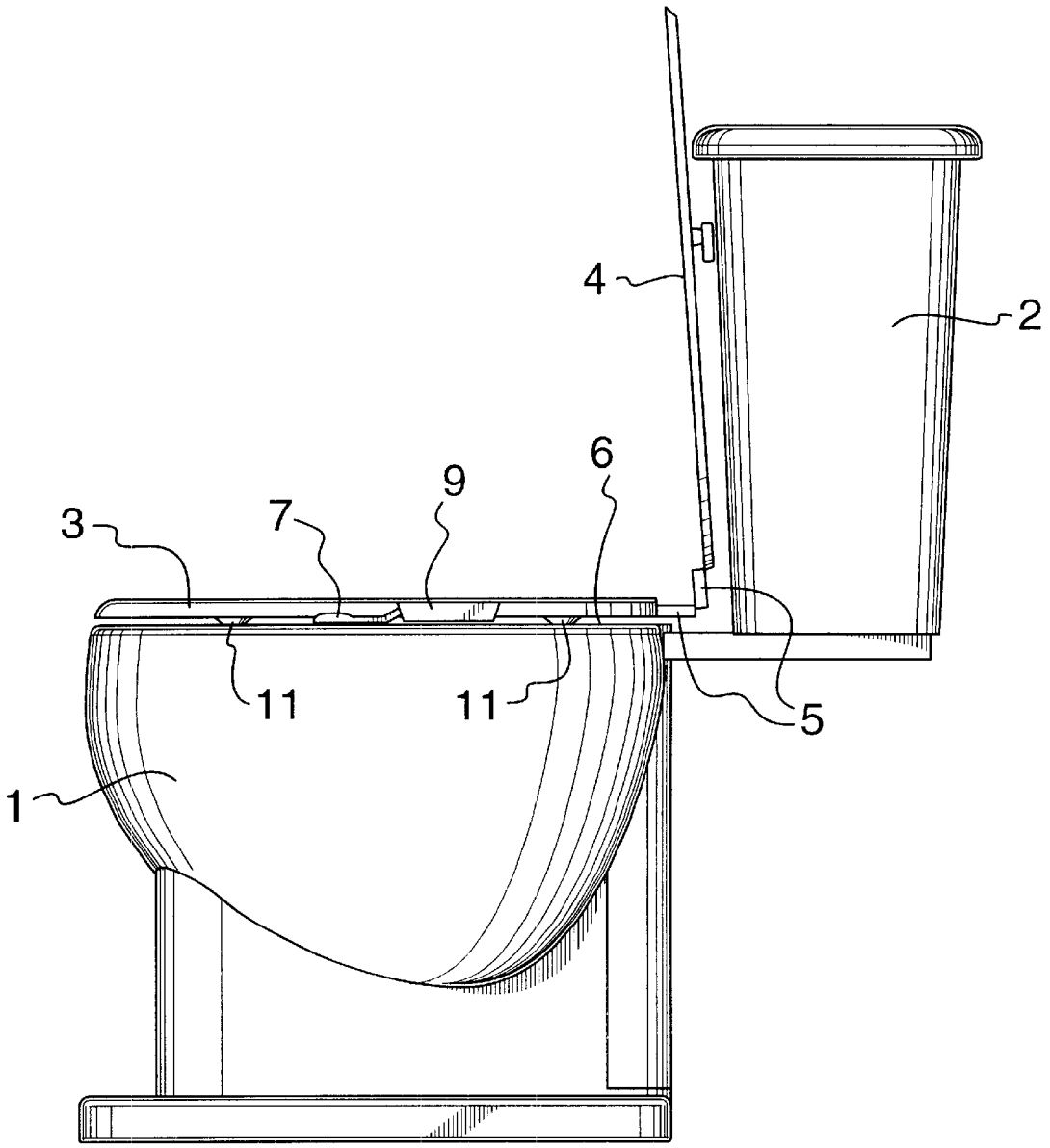
FIG. 7 is a side elevational view of the lifting device and toilet as shown in FIG. 6, with the cover raised and the seat in a lowered position.
Figure 8:
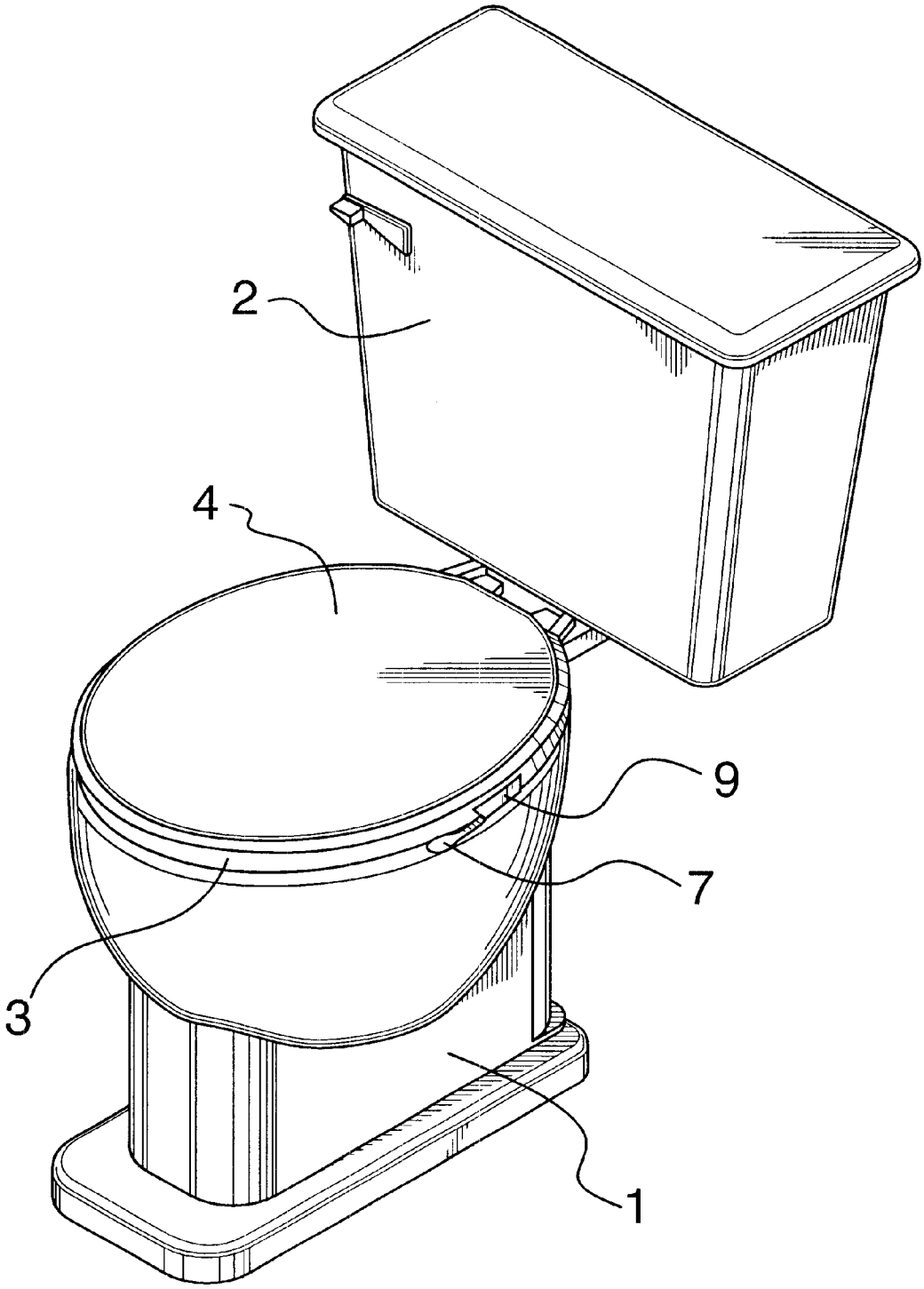
FIG. 8 is a perspective view of the toilet seat lifting device in use with the seat and cover in a lowered position.

FIGS. 6 to 8 show a conventional toilet equipped with a bowl 1, a water storage tank 2, seat bumpers 11, and a rimmed seat 3 and cover 4 assembly which is pivotally connected by hinges 5 to the upper surface 6 of the toilet bowl 1. The lifting device 20 of the present invention is shown attached to the underside of seat 3 with a handle 7 of the device disposed outwardly adjacent the edge of the seat.

Referring to FIG. 8, toilet seat 3 and cover 4 are shown in a lowered, closed position, with the handle 7, affixed to the seat 3 and ready to aid in sanitary lifting. Seat 3 and cover 4 are raised and lowered by manually grasping the handle of the device by hand, and pulling or pushing in an upward or downward direction. The cover cannot be lowered using the handle obviously, but manual lowering of the cover is of less sanitary concern.

FIG. 7 shows the lifting device secured in the preferred position on the seat's rim, approximately mid-way between the front and rear of seat 3. The seat bumpers 11 create sufficient space between seat 3 and the upper surface 6 of bowl 1 to allow the device to be properly attached to the edges of seat 3.

Figure 1:
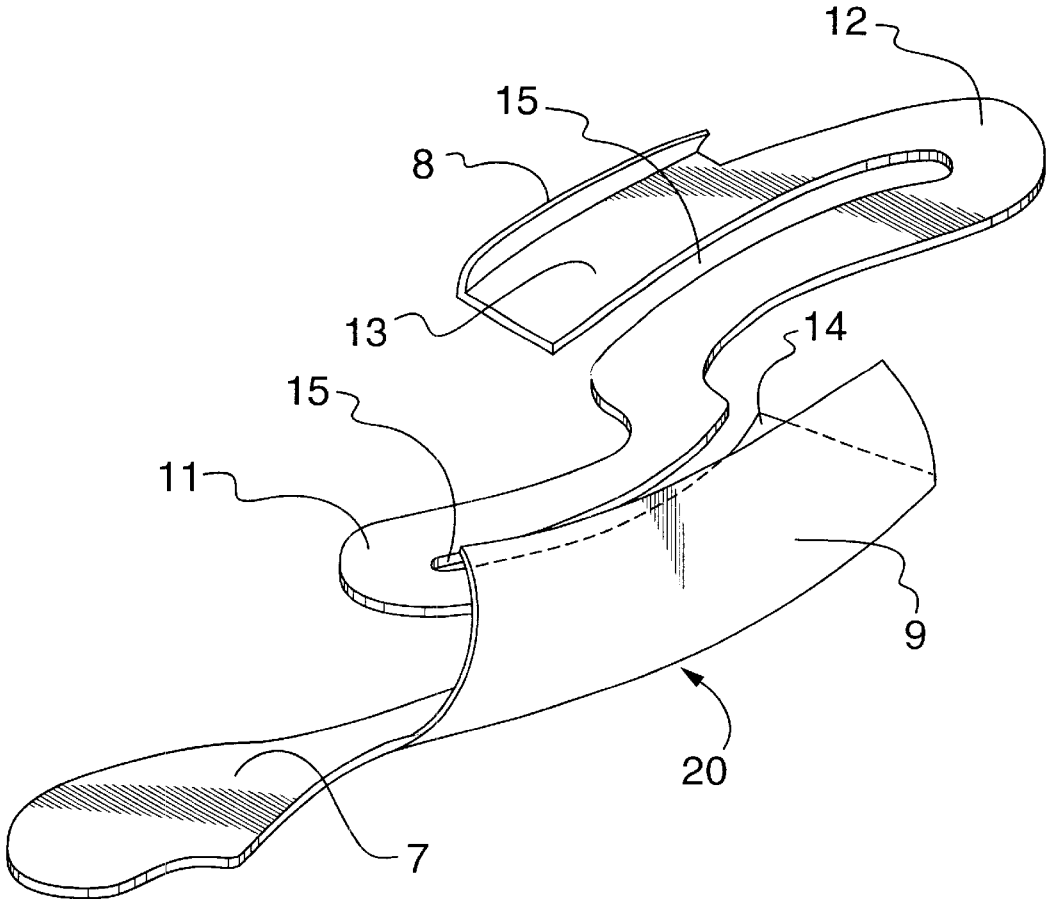
FIG. 1 is an upper perspective view of the lifting device of the present invention.

The means of attachment is better illustrated in FIGS. 1 and 6. FIG. 6 shows toilet seat 3 and cover 4 in a raised position with the lifting device clipped to the underside of the seat. Referring to FIG. 1, to secure the lifting device, an inner clip 8 is adapted to engage the inner edge of the toilet seat, and a similarly shaped outside clip 9 is adapted to engage the outer edge of seat 3. Also forming part of the preferred one-piece moulding of the device are a forward flange or lever 11, and a rearward flange or lever 12. These lie flat against the underside of the toilet seat between the inner clip 8 and outer clip 9 to provide more support to the device and prevent the clips from twisting and separating from the seat when handle 7 is used to raise or lower the seat as needed. Flanges 11 and 12 therefore effectively counter the torque that would otherwise be applied to the clips through handle 7 due to the weight of the seat and cover.

Figure 2:
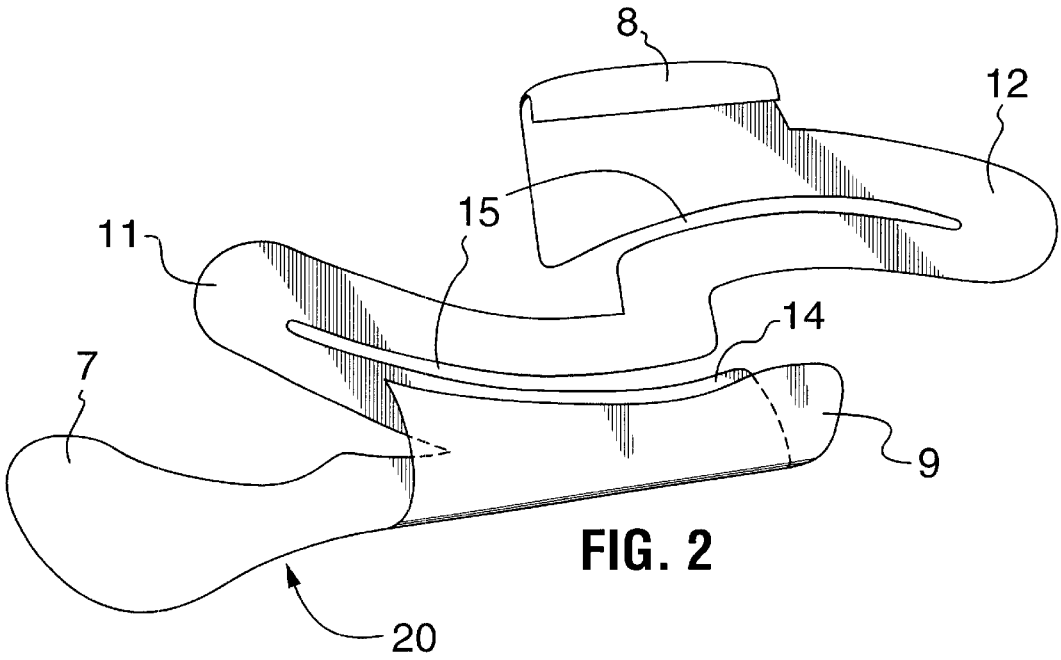
FIG. 2 is a top plan view of the lifting device as shown in FIG. 1.
Figure 3:
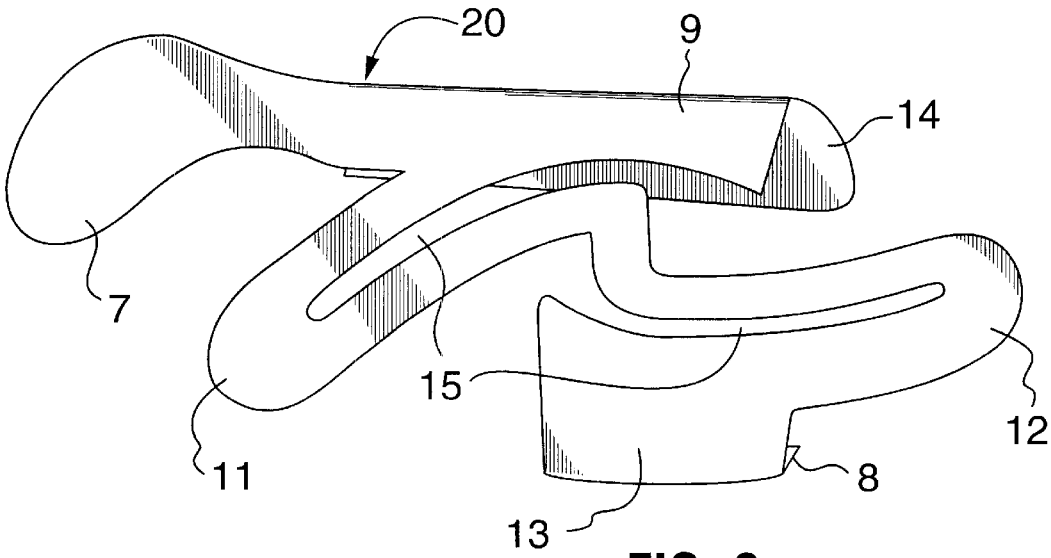
FIG. 3 is a bottom perspective view of the lifting device as shown in FIG. 1.
Figure 4:
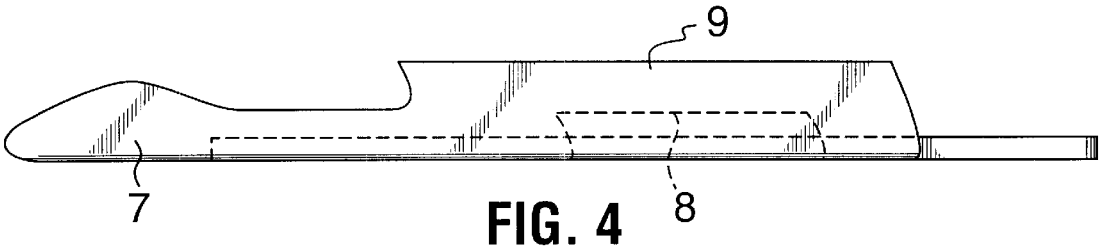
FIG. 4 is a side elevational view of the lifting device as seen from the outside.
Figure 5:
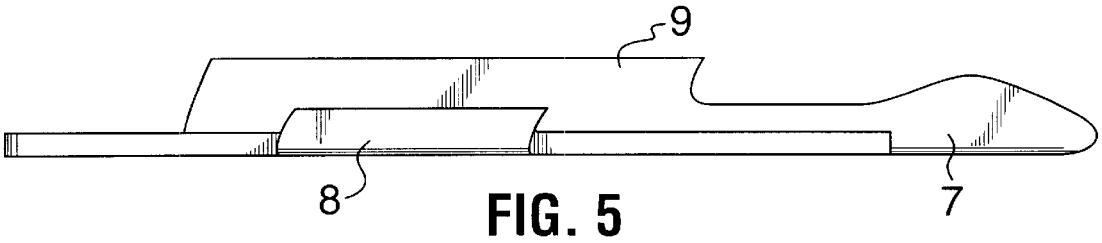
FIG. 5 is a side elevational view of the lifting device as seen from the inside.

With reference to FIGS. 2 and 3, inside clips 8 and 9 run generally parallel to the opposed edges of the seat and consist of a flexible material that allows them to deflect enough to clip on and off the seat. The clips are preferably curved relative to their longitudinal axes to better grip the seat's similarly curved outer edges.

The lifting device can be easily affixed to the toilet seat by placing it against the underside of the seat and snapping the clips into place snugly around the inner and outer edges of the seat, so that the outwardly extending handle is secured in place and ready for use. The openings 15 between the forward 11 and rearward 12 levers allow the device to expand as the clips are snapped into place. The resiliency of the plastic material from which device 20 is preferably made pulls the clip into a compressive friction fit against the seat's edges. The "coiled" or switchbacked configuration of the device thusly allows it to fit seat rims of different widths.

The lifting device is easily removed for cleaning by unsnapping clips 8 and 9 from around the seat edge and pulling the device away from the underside of the seat.

All of the above features provide an illustration of the preferred embodiment of the invention, but are not intended to limit the scope of the invention, which is fully described in the claim below.

The embodiments of the invention in which an exclusive property or privilege is claimed are defined as follows:

1. A lifting aid for a pivotable, rimmed seat, comprising:

attachment means for releasably connecting said aid to laterally opposite edges of the said seat's rim, said attachment means being adapted to compressably clip against said edges of said seat rim;

a flange portion extending between said attachment means, said flange portion being disposed beneath a lower surface of said seat when said aid is attached thereto and including a first portion extending forwardly relative to said seat and a second portion extending rearwardly relative to said seat, said first and second portions cooperating to inhibit rotation of said aid about the horizontal transverse axis thereof when said aid is used to raise or lower said seat; and a handle disposed outwardly relative to said attachment means so that said handle is conveniently positioned for lifting and lowering said seat when said aid is connected thereto, wherein said attachment means, said flange portion and said handle are formed integrally as a unitary piece, and said aid, when seen in plan, is switched backed in configuration, allowing said aid to laterally expand and contract for compressably clipping against seat rims of different widths.

2. The aid of claim 1 wherein said attachment means comprises a pair of opposed, generally C-shaped clips.

3. The aid of claim 2 manufactured from a flexible plastics material.

* * * * *